US010790620B2

(12) United States Patent
Yuan et al.

(10) Patent No.: US 10,790,620 B2
(45) Date of Patent: Sep. 29, 2020

(54) HIGH-SPEED ELECTRICAL CONNECTOR, SIGNAL MODULE THEREOF AND METHOD FOR FORMING SIGNAL MODULE

(71) Applicant: AVIC JONHON OPTRONIC TECHNOLOGY CO., LTD, Henan (CN)

(72) Inventors: Junfeng Yuan, Henan (CN); Dong Li, Henan (CN); Guoqi Zhou, Henan (CN)

(73) Assignee: AVIC JONHON OPTRONIC TECHNOLOGY CO., LTD, Henan (CN)

( * ) Notice: Subject to any disclaimer, the term of this patent is extended or adjusted under 35 U.S.C. 154(b) by 0 days.

(21) Appl. No.: 16/079,560

(22) PCT Filed: Mar. 21, 2017

(86) PCT No.: PCT/CN2017/077554
§ 371 (c)(1),
(2) Date: Aug. 24, 2018

(87) PCT Pub. No.: WO2018/018900
PCT Pub. Date: Feb. 1, 2018

(65) Prior Publication Data

US 2019/0027872 A1 Jan. 24, 2019

(30) Foreign Application Priority Data

Jul. 29, 2016 (CN) ..... 2016 1 0610611

(51) Int. Cl.
*H01R 13/6585* (2011.01)
*H01R 13/6591* (2011.01)
(Continued)

(52) U.S. Cl.
CPC ..... *H01R 13/6594* (2013.01); *H01R 13/405* (2013.01); *H01R 13/6585* (2013.01);
(Continued)

(58) Field of Classification Search
CPC ..... H01R 13/658; H01R 13/6585; H01R 13/6591; H01R 13/6594; H01R 13/6471; H01R 13/6599; H01R 43/24
See application file for complete search history.

(56) References Cited

U.S. PATENT DOCUMENTS 6,409,543 B1 * 6/2002 Astbury, Jr. ..... H01R 13/6587 439/607.07
8,469,745 B2 * 6/2013 Davis ..... H01R 12/724 439/607.07
(Continued)

FOREIGN PATENT DOCUMENTS

CN 102437456 5/2012
CN 102969621 3/2013
(Continued)

OTHER PUBLICATIONS

"International Search Report (Form PCT/ISA/210)", dated Jun. 28, 2017, with English translation thereof, pp. 1-4.
(Continued)

*Primary Examiner* — Vanessa Girardi
(74) *Attorney, Agent, or Firm* — JCIPRNET

(57) ABSTRACT

A high-speed electrical connector, comprising a signal module (1). The signal module comprises a contact (11). At least one side of the contact is provided with a shield piece (12). The signal module further comprises an insulator (13). The insulator is formed on the contact and the shield piece by means of injection moulding so as to combine the contact and the shield piece together. The insulator of the signal module of the electrical connector is encapsulated on the contact and the shield piece by means of injection moulding. Thus, the degree of stability of the signal module is enhanced, and the problem that a signal module of an existing high-speed electrical connector is easily deformed is solved.

7 Claims, 2 Drawing Sheets

(51) Int. Cl.

| | |
|---|---|
| ***H01R 43/24*** | (2006.01) |
| ***H01R 13/6594*** | (2011.01) |
| ***H01R 13/405*** | (2006.01) |
| ***H01R 13/6587*** | (2011.01) |
| *H01R 12/72* | (2011.01) |

(52) U.S. Cl.

CPC ..... *H01R 13/6587* (2013.01); *H01R 13/6591* (2013.01); *H01R 43/24* (2013.01); *H01R 12/724* (2013.01)

(56) References Cited

U.S. PATENT DOCUMENTS

| | | | | |
|---|---|---|---|---|
| 9,312,642 | B2 * | 4/2016 | Wang ..... | H01R 13/6587 |
| 2001/0012729 | A1 | 8/2001 | Van Woensel | |
| 2011/0009001 | A1 | 1/2011 | Chen et al. | |
| 2014/0220827 | A1 | 8/2014 | Hsu et al. | |
| 2014/0342607 | A1 | 11/2014 | Wang et al. | |
| 2015/0364888 | A1 | 12/2015 | Yu et al. | |

FOREIGN PATENT DOCUMENTS

| | | |
|---|---|---|
| CN | 103151649 | 6/2013 |
| CN | 203339423 | 12/2013 |
| CN | 102437456 | 12/2014 |
| CN | 104183990 | 12/2014 |
| CN | 204103125 | 1/2015 |
| CN | 105281086 | 1/2016 |
| CN | 204947159 | 1/2016 |
| CN | 205039301 | 2/2016 |
| CN | 105703157 | 6/2016 |
| CN | 106207569 | 12/2016 |
| JP | 2004521448 | 7/2004 |
| JP | 2007516565 | 6/2007 |
| JP | 2008515167 | 5/2008 |
| JP | 2014532283 | 12/2014 |
| KR | 101615269 | 4/2016 |

OTHER PUBLICATIONS

"Office Action of Japan Counterpart Application," dated Sep. 10, 2019, p. 1-p. 5.

"Notice of Allowance of Japan Counterpart Application," dated Jan. 7, 2020, p. 1-p. 3.

* cited by examiner

HIGH-SPEED ELECTRICAL CONNECTOR, SIGNAL MODULE THEREOF AND METHOD FOR FORMING SIGNAL MODULE

CROSS-REFERENCE TO RELATED APPLICATION

This application is a 371 application of the international PCT application serial no. PCT/CN2017/077554, filed on Mar. 21, 2017, which claims the priority benefit of China application no. 201610610611.7, filed on Jul. 29, 2016. The entirety of each of the above-mentioned patent applications is hereby incorporated by reference herein and made a part of this specification.

BACKGROUND OF THE INVENTION

1. Field of the Invention

The present invention relates to the field of connectors, in particular, to a high-speed electrical connector and a signal module thereof and a forming method of the signal module.

2. Description of Related Art

An existing high-speed electrical connector mainly consists of a shell, contact modules assembled in the shell in a stacking manner and shield pieces arranged between the contact modules, a signal module comprises the contact modules and the shield pieces arranged between the contact modules; for example, China Patent Application, entitled "Connector and Contact Module thereof and Forming Method of Contact Module" with the notification number of CN102437456B and the announcement date of Dec. 10, 2014, the connector comprises a front base plate and at least two stacked contact modules assembled on the front base plate; the contact module comprises a slice type insulator and a contact encapsulated in the insulator by means of injection moulding; the shield piece is arranged at one side of each contact module in a clamping manner; the shield pieces and the contact modules form the signal module of the connector; and during manufacturing, firstly, all contacts of the contact modules are located and put in the same injection mould in a matching manner, and then are encapsulated by means of injection moulding, and thus, the production efficiency of the contact modules is greatly increased, however, a shield module structure of clamping the shield pieces on the insulator has low degree of stability, and is easily deformed in an assembly process.

SUMMARY OF THE INVENTION

The present invention is directed to a high-speed electrical connector so as to solve the problem that a signal module of an existing high-speed electrical connector is easily deformed; in addition, the present invention is also directed to a signal module used by the high-speed electrical connector and a forming method of the signal module.

In order to realize the objectives, the technical solution of the high-speed electrical connector of the present invention is as follows: the high-speed electrical connector comprises a signal module; the signal module comprises a contact; at least one side of the contact is provided with a shield piece; the signal module further comprises an insulator; and the insulator is formed on the contact and the shield piece by means of injection moulding so as to combine the contact and the shield piece together. The insulator of the signal module is formed on the contact and the shield piece by means of injection moulding, and thus, the degree of stability of the signal module is enhanced.

Further, the insulator comprises a contact insulator part encapsulated on the contact by means of injection moulding and a shield piece insulator part encapsulated on the shield piece by means of injection moulding; and the shield piece insulator part encapsulates the shield piece on the contact insulator part by means of injection moulding after encapsulating the contact insulator part by means of injection moulding. Thus, a support fixture in an injection mould is simplified, and meanwhile, the accurate relative position relationship between the shield piece and the contact can also be ensured.

Further, the contact comprises differential pairs and ground connection contacts arranged between the differential pairs; at least one of the ground connection contacts and the shield piece is provided with bulge structures being bulged toward the other one; and the ground connection contacts are electrically contacted with the shield piece by the corresponding bulge structures.

The technical solution of the signal module of the present invention is as follows: the signal module comprises a contact; at least one side of the contact is provided with a shield piece; the signal module further comprises an insulator; and the insulator is formed on the contact and the shield piece by means of injection moulding so as to combine the contact and the shield piece together.

Further, the insulator comprises a contact insulator part and a shield piece insulator part, the shield piece insulator part encapsulates the shield piece on the contact insulator part by means of injection moulding after encapsulating the contact insulator part by means of injection moulding.

Further, the contact comprises differential pairs and ground connection contacts arranged between the differential pairs; at least one of the ground connection contacts and the shield piece is provided with bulge structures being bulged toward the other one; and the ground connection contacts are electrically contacted with the shield piece by the corresponding bulge structures.

The technical solution of a forming method of the signal module of the present invention is as follows: the insulator of the signal module is formed on the contact and the shield piece by means of injection moulding so as to combine the contact and the shield piece together.

Further, injection molding of the insulator of the signal module comprises the following steps: (1) putting the contact in a corresponding mold, encapsulating on the contact by means of injection moulding, forming the contact insulator part on the encapsulated contact, and an insertion end of the contact being outside the contact insulator part; and (2) putting the encapsulated contact and the contact insulator part in the corresponding mold, then compressing the shield piece on the contact insulator part tightly, encapsulating on the shield piece by means of injection moulding, and forming the shield piece insulator part on the encapsulated shield piece, the shield piece insulator part and the contact insulator part forming the insulator of the signal module.

Further, a locating slot suitable for the shield piece is formed in the contact insulator part manufactured in step (1); and in step (2), the shield piece is pushed tightly in the locating slot, and then the shield piece is encapsulated by means of injection moulding.

Further, the contact in step (1) comprises differential pairs and ground connection contacts arranged between the differential pairs; at least one of the ground connection contacts and the shield piece is provided with bulge structures being bulged toward the other one; the ground connection contacts are electrically contacted with the shield piece by the corresponding bulge structures; and avoidance holes for avoiding the bulge structures are formed on the contact insulator part manufactured in step (1).

The present invention has the beneficial effects that the signal module of the high-speed electrical connector comprises the insulator; the insulator is formed on the contact and the shield piece by means of injection moulding so as to combine the contact and the shield piece together, and thus, the fixation of the shield piece and the contact is realized; and compared with a signal module of an existing electrical connector, the signal module of the electrical connector of the present invention has the advantages that the insulator of the signal module of the electrical connector is encapsulated on the contact and the shield piece by means of injection moulding, thus, the degree of stability of the signal module is enhanced, and the problem that the signal module of the existing high-speed electrical connector is easily deformed is solved.

Further, the insulator comprises the contact insulator part encapsulated on the contact by means of injection moulding and the shield piece insulator part encapsulated on the shield piece by means of injection moulding; the shield piece insulator part encapsulates the shield piece on the contact insulator part by means of injection moulding after encapsulating the contact insulator part by means of injection moulding; and thus, the support fixture in the injection mould is simplified, and meanwhile, the accurate relative position relationship between the shield piece and the contact can also be ensured.

Further, the contact comprises differential pairs and ground connection contacts arranged between the differential pairs; at least one of the ground connection contacts and the shield piece is provided with bulge structures being bulged toward the other one; the ground connection contacts are electrically contacted with the shield piece by the corresponding bulge structures; and thus, the mutual interference between the adjacent differential pairs is completely avoided, the encapsulation by means of injection moulding can simplify the connection relationship between the ground connection contact and the shield piece, and meanwhile, can also ensure the good electrical connection between the ground connection contact and the shield piece.

DESCRIPTION OF THE EMBODIMENTS

The implementation mode of the present invention is further described with the accompanying drawings below.

Figure 1:
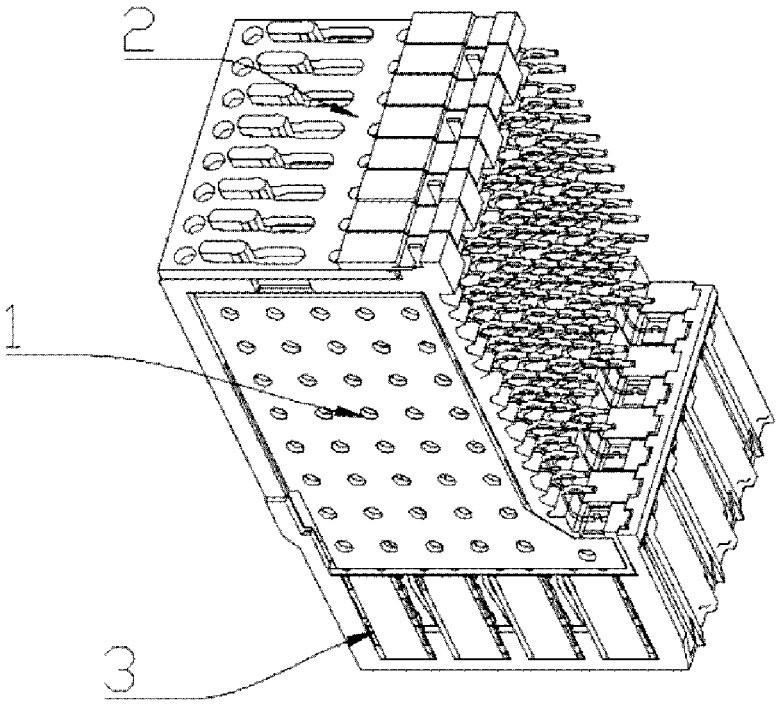
FIG. 1 is a structural schematic diagram of a specific embodiment of a high-speed electrical connector of the present invention.
Figure 2:
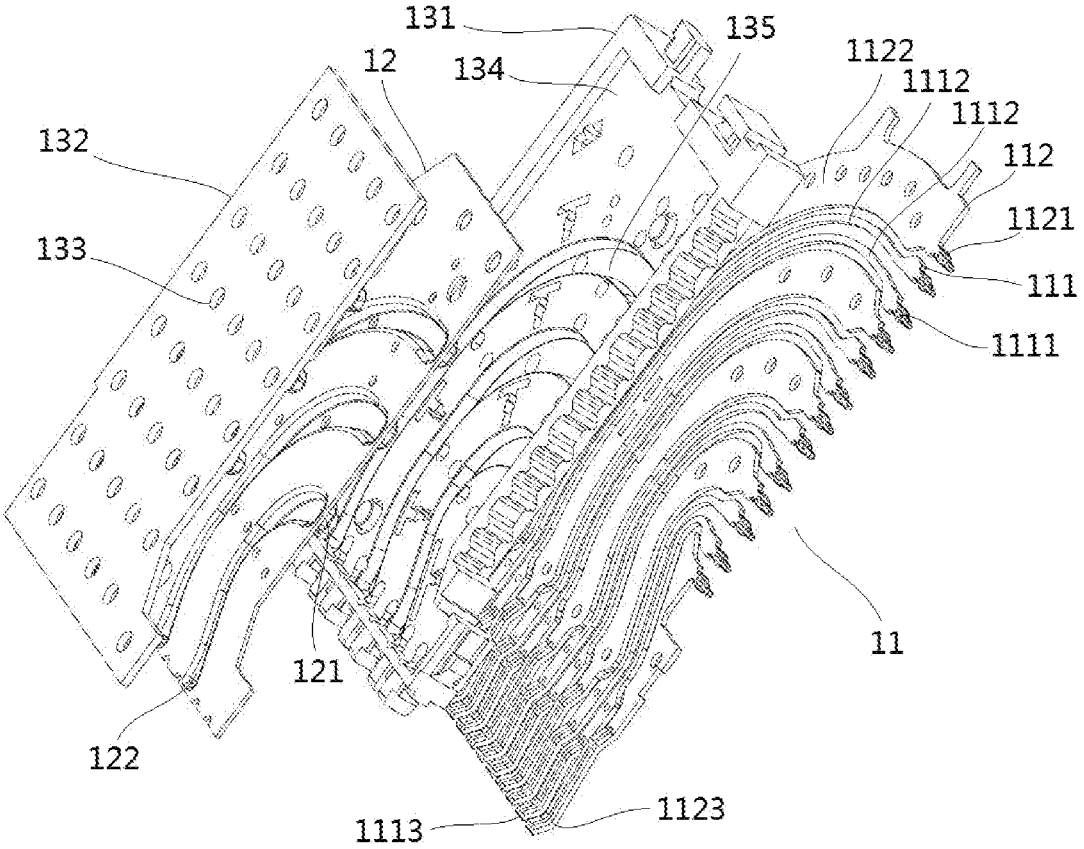
FIG. 2 is an explosive view of a signal module of the specific embodiment of the high-speed electrical connector of the present invention.
Figure 3:
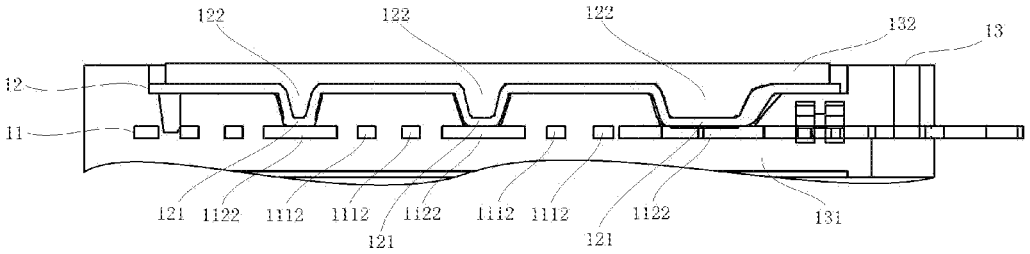
FIG. 3 is a sectional view of the signal module of the specific embodiment of the high-speed electrical connector of the present invention.

A specific embodiment of an electrical connector of the present invention is as shown in FIG. 1 to FIG. 3, the electrical connector comprises a signal module 1, a fixing plate 2 for fixing adjacent signal modules, and a shell 3 for installing the signal module, the signal module comprises a contact 11 and an insulator 13, one side of the contact is provided with a shield piece 12, in the present embodiment, the contact is of a layer structure, and the contact comprises differential pairs 111 and ground connection contacts 112, the differential pairs are clamped between the two ground connection contacts, the arrangement mode of the differential pairs and the ground connection contacts belongs to the prior art, and the descriptions thereof are omitted. The shield piece 12 is provided with bulge structures being bulged toward the ground connection contacts, the bulge structures are strip bulges 121 which extend in parallel with the differential pairs, grooves 122 sinking toward the bulge structures are formed in the backs, and the backs face backward to the bulge direction of the bulge structures, the ground connection contacts are electrically contacted with the shield piece by the corresponding bulge structures, and the adjacent differential pairs are isolated. The insulator 13 is encapsulated on the contact and the shield piece by means of injection moulding. In the present embodiment, the insulator 13 comprises a contact insulator part 131 encapsulated on the contact by means of injection moulding and a shield piece insulator part 132 encapsulated on the shield piece by means of injection moulding, the shield piece insulator part encapsulates the shield piece on the contact insulator part by means of injection moulding after encapsulating the contact insulator part by means of injection moulding. Technological holes 133 are formed in the shield piece insulator part 132, during injection moulding, push rods of an injection mold push the shield piece so as to compress the shield piece tightly on the contact insulator part; and after forming, the push rods quit, and the technological holes are formed. FIG. 2 marks a differential pair formed by paired adjacent signal pins 111. The signal pin 111 is formed by a signal pin body part 1112 and a signal pin contact part 1113 and a signal pin tail part 1111 arranged on two ends of the signal pin body part 1112. A ground pin 112 (ground connection contact) is provided between the adjacent differential pairs. The ground pin 112 includes a ground pin body part 1122 and a ground pin contact part 1123 and a ground pin tail part 1121 arranged on two ends of the ground pin body part 1122. FIG. 3 is a longitudinal cross-sectional view of a signal module (wafer) in which the respective parts in FIG. 2 are assembled. The cross-section exposes a cross-section of the signal pin body part 1112 of the signal pin 111, a cross-section of the ground pin body part 1122 of the ground pin 122, and a cross-section of the shield piece 12. The grooves 122 are formed on the backs of the strip bulges 121 by pressing. As shown in the cross-section, the strip bulges 121 of the shield piece 12 are in electrical contact with the ground pin body parts 1122 of the ground pins 112, and the strip bulges 121 extend in parallel with the signal pin body parts 1112 and the ground pin body parts 1122 along a direction perpendicular to the surface of FIG. 3.

A forming method of a specific signal module comprises the following steps: (1) putting the contact 11 in a corresponding mold, encapsulating on the contact 11 by means of injection moulding, forming the contact insulator part 131 on the encapsulated contact 11, an insertion end of the contact 11 being outside the contact insulator part 131, and forming a locating slot 134 with the shape suitable for the shape of the shield piece 12 and avoidance holes 135 for avoiding the bulge structures on the contact insulator part 131; and (2) putting the encapsulated contact 11 and the contact insulator part 131 in the corresponding mold, then compressing the shield piece 12 in the locating slot 134 of the contact insulator part 131 tightly, correspondingly inserting the bulge structures on the shield piece 12 into the avoidance holes 135 so as to ensure the electrical contact between the shield piece 12 and the ground connection contacts 112, encapsulating on the shield piece 12 by means of injection moulding, and forming the shield piece insulator part 132 on the encapsulated shield piece 12, the shield piece insulator part 132 and the contact insulator part 131 forming the insulator 13 of the signal module 1.

The difference between a specific embodiment 2 of a high-speed electrical connector of the present invention and the specific embodiment 1 of the foregoing high-speed electrical connector only lies in that the shield piece 12 and the contact 11 in the present embodiment 2 are put in a corresponding mould together and are encapsulated by means of injection moulding.

According to a specific embodiment of the signal module of the present invention, the signal module has the same structure as that of the signal module of the specific embodiment 1 or 2 of the foregoing high-speed electrical connector, and the descriptions thereof are omitted herein.

According to a special embodiment of a forming method of the signal module of the present invention, the forming method of the signal module comprises the same steps as that of the forming method of the signal module of the specific embodiment 1 or 2 of the high-speed quick electrical connector, and the descriptions thereof are omitted.

In other embodiments, the foregoing signal module can also be provided with two shield pieces, namely, two sides of the contact are both provided with the shield pieces; the bulge structures can also be omitted on the foregoing shield piece, a bulge structure being bulged toward one side of the shield piece is arranged on the ground connection contact; the ground connection contact can also be omitted on the signal module, and in this case, shielding is carried out only through the shield piece.

What is claimed is:

1. A signal module, comprising: a contact, at least one side of the contact providing with a shield piece; wherein the signal module further comprises an insulator, and the insulator is formed on the contact and the shield piece by means of injection moulding so as to combine the contact and the shield piece together, wherein the contact comprises differential pairs and ground connection contacts arranged between the differential pairs, each signal pin of the differential pair comprises a signal pin contact part, a signal pin body part, and a signal pin tail part, one end of the signal pin body part is connected with the signal pin contact part, another end of the signal pin body part is connected with the signal pin tail part, the ground connection contact comprises a ground pin contact part, a ground pin body part, and a ground pin tail part, one end of the ground pin body part is connected with the ground pin contact part, another end of the ground pin body part is connected with the ground pin tail part, the signal pin body parts of two signal pins belonging to the same differential pair are arranged in adjacency with each other, the ground pin body part is arranged between the signal pin body parts not belonging to the same differential pair, the ground pin body parts and the signal pin body parts are arranged in parallel and extend on a same plane, at least one of the ground pin body parts of the ground connection contacts and the shield piece is provided with bulge structures being bulged toward the other one, the bulge structures being strip bulges extending in parallel with the signal pin body parts, and the ground pin parts of the ground connection contacts are electrically contacted with the shield piece by the corresponding bulge structures and isolate the adjacent differential pairs from one another;

wherein the shield piece, the two adjacent bulge structures and the two adjacent ground pin body parts corresponding to the two adjacent bulge structures define a shielding cavity, and each of the differential pair is wrapped in the shielding cavity, and the strip bulges uninterrupted respectively lean against the ground pin body parts along the ground pin body parts.

2. The signal module according to claim 1, wherein the insulator comprises a contact insulator part and a shield piece insulator part, and the shield piece insulator part encapsulates the shield piece on the contact insulator part by means of injection moulding after encapsulating the contact insulator part by means of injection moulding.

3. A high-speed electrical connector, comprising: a signal module, the signal module comprising a contact, and at least one side of the contact providing with a shield piece; wherein the signal module further comprises an insulator, and the insulator is formed on the contact and the shield piece by means of injection moulding so as to combine the contact and the shield piece together, wherein the contact comprises differential pairs and ground connection contacts arranged between the differential pairs, each signal pin of the differential pair comprises a signal pin contact part, a signal pin body part, and a signal pin tail part, one end of the signal pin body part is connected with the signal pin contact part, another end of the signal pin body part is connected with the signal pin tail part, the ground connection contact comprises a ground pin contact part, a ground pin body part, and a ground pin tail part, one end of the ground pin body part is connected with the ground pin contact part, another end of the ground pin body part is connected with the ground pin tail part, the signal pin body parts of two signal pins belonging to the same differential pair are arranged in adjacency with each other, the ground pin body part is arranged between the signal pin body parts that are adjacent but do not belong to the same differential pair, the ground pin body parts and the signal pin body parts are arranged in parallel and extend on a same plane, at least one of the ground pin body parts of the ground connection contacts and the shield piece is provided with bulge structures being bulged toward the other one, the bulge structures being strip bulges extending in parallel with the signal pin body parts, and the ground pin parts of the ground connection contacts are electrically contacted with the shield piece by the corresponding bulge structures and isolate the adjacent differential pairs from one another;

wherein the shield piece, the two adjacent bulge structures and the two adjacent ground pin body parts corresponding to the two adjacent bulge structures define a shielding cavity, and each of the differential pair is wrapped in the shielding cavity, and the strip bulges uninterrupted respectively lean against the ground pin body parts along the ground pin body parts.

4. The high-speed electrical connector according to claim 3, wherein the insulator comprises a contact insulator part encapsulated on the contact by means of injection moulding, and a shield piece insulator part encapsulated on the shield piece by means of injection moulding, and the shield piece insulator part encapsulates the shield piece on the contact insulator part by means of injection moulding after encapsulating the contact insulator part by means of injection moulding.

5. A forming method of a signal module, wherein an insulator of the signal module is formed on a contact and a shield piece by means of injection moulding so as to combine the contact and the shield piece together, wherein injection molding of the insulator of the signal module comprises the following steps: (1) putting the contact in a corresponding mold, carrying out injection moulding encapsulation on the contact, forming a contact insulator part on the encapsulated contact, and an insertion end of the contact being outside the contact insulator part; and (2) putting the encapsulated contact and the contact insulator part in the corresponding mold, then compressing the shield piece on the contact insulator part tightly, carrying out injection moulding encapsulation on the shield piece, and forming a shield piece insulator part on the encapsulated shield piece, the shield piece insulator part and the contact insulator part form the insulator of the signal module; and the contact in step (1) comprises differential pairs and ground connection contacts arranged between the differential pairs, at least one of the ground connection contacts and the shield piece is provided with bulge structures being bulged toward the other one, the ground connection contacts are electrically contacted with the shield piece by the corresponding bulge structures, wherein each signal pin of the differential pair comprises a signal pin body part and a signal pin contact part and a signal pin tail part connected with two opposite sides of the signal pin body part, each of the ground connection contacts comprises a ground pin body part and a ground pin contact part and a ground pin tail part connected with two opposite sides of the ground pin body part, injection moulding for the signal pin contact part, the signal pin tail part, the ground pin contact part, and the ground pin tail part is done in step (1), and the shield piece is not provided with an insert structure;

wherein the shield piece, the two adjacent bulge structures and the two adjacent ground pin body parts corresponding to the two adjacent bulge structures define a shielding cavity, and each of the differential pair is wrapped in the shielding cavity, and the strip bulges uninterrupted respectively lean against the ground pin body parts along the ground pin body parts.

6. The forming method of the signal module according to claim 5, wherein a locating slot suitable for the shield piece is formed on the contact insulator part manufactured in step (1); and in step (2), the shield piece is pushed tightly in the locating slot, and then the shield piece is encapsulated by means of injection moulding.

7. The forming method of the signal module according to claim 5, wherein avoidance holes for avoiding the bulge structures are formed on the contact insulator part manufactured in step (1).

* * * * *